US007353971B2

(12) United States Patent
Stradella

(10) Patent No.: US 7,353,971 B2
(45) Date of Patent: Apr. 8, 2008

(54) LATERALLY-ACTUATED FLUID DISPENSING DEVICE

(75) Inventor: Giuseppe Stradella, Camogli (IT)

(73) Assignee: Tebro S.A., Luxembourg (LU)

( * ) Notice: Subject to any disclaimer, the term of this patent is extended or adjusted under 35 U.S.C. 154(b) by 500 days.

(21) Appl. No.: 10/491,572

(22) PCT Filed: Oct. 1, 2002

(86) PCT No.: PCT/EP02/10993

§ 371 (c)(1),
(2), (4) Date: Apr. 5, 2004

(87) PCT Pub. No.: WO03/031077

PCT Pub. Date: Apr. 17, 2003

(65) Prior Publication Data

US 2004/0262339 A1 Dec. 30, 2004

(30) Foreign Application Priority Data

Oct. 4, 2001 (FR) ..... 01 12769

(51) Int. Cl.
*B67D 5/64* (2006.01)

(52) U.S. Cl. ..... 222/162; 222/81; 222/82; 222/182; 222/209; 222/402.15

(58) Field of Classification Search ..... 222/321.8, 222/162, 182–183, 321.1, 517, 402.13, 402.15, 222/321.7, 509, 321.9, 207, 209, 632–633, 222/80–82, 383.1, 83
See application file for complete search history.

(56) References Cited

U.S. PATENT DOCUMENTS

| | | | | | |
|---|---|---|---|---|---|
| 3,272,391 | A * | 9/1966 | Meshberg | 222/162 |
| 4,033,487 | A * | 7/1977 | Micallef | 222/207 |
| 4,807,786 | A * | 2/1989 | Gueret | 222/499 |
| 5,139,180 | A * | 8/1992 | Lucas | 222/402.13 |
| 5,261,571 | A * | 11/1993 | Goncalves | 222/214 |
| 5,273,191 | A | 12/1993 | Meshberg | |
| 5,358,147 | A * | 10/1994 | Adams et al. | 222/183 |
| 5,395,032 | A * | 3/1995 | Fuchs | 222/190 |
| 5,487,489 | A * | 1/1996 | Weiss et al. | 222/1 |
| 5,727,716 | A * | 3/1998 | Hochstein et al. | 222/321.8 |
| 5,899,365 | A | 5/1999 | Eichler et al. | |
| 6,401,984 | B1 * | 6/2002 | Jumel | 222/183 |

(Continued)

FOREIGN PATENT DOCUMENTS

EP 0 557 714 A 9/1993

(Continued)

*Primary Examiner*—Frederick C. Nicolas
(74) *Attorney, Agent, or Firm*—Sughrue Mion, PLLC

(57) ABSTRACT

A fluid dispenser device having a body (10), a fluid reservoir (20) containing one or a plurality of doses of fluid, a piston (30) designed to slide in the reservoir so as to dispense a dose of fluid each time the device is actuated, and actuator (40) for displacing the piston (30), the device being characterized in that it includes at least two laterally-actuated elements (50, 60) distributed around the body (10), the laterally-actuated elements (50, 60) being displaced simultaneously in a direction that is approximately transverse to the central axis of the device, and each co-operating with a peripheral edge (41) of the actuator (40) so as to exert an axial force thereon.

20 Claims, 3 Drawing Sheets

U.S. PATENT DOCUMENTS

| | | | | |
|---|---|---|---|---|
| 6,419,124 | B1 * | 7/2002 | Hennemann et al. | 222/321.6 |
| 6,938,798 | B2 * | 9/2005 | Stradella | 222/82 |
| 6,964,381 | B2 * | 11/2005 | Stradella et al. | 239/333 |
| 7,108,159 | B2 * | 9/2006 | Stradella | 222/162 |
| 7,175,053 | B2 * | 2/2007 | Simon et al. | 222/162 |
| 2005/0139615 | A1 * | 6/2005 | Stradella et al. | 222/321.8 |
| 2006/0191959 | A1 * | 8/2006 | Davies et al. | 222/162 |

FOREIGN PATENT DOCUMENTS

| | | |
|---|---|---|
| FR | 1 444 387 A | 7/1966 |
| FR | 2 671 294 A | 7/1992 |

* cited by examiner

LATERALLY-ACTUATED FLUID DISPENSING DEVICE

FIELD OF THE INVENTION

The present invention relates to a fluid dispenser device, and more particularly to a laterally-actuated fluid dispenser device.

BACKGROUND

In most fluid dispenser devices, whether in the field of pharmacy, perfumery, cosmetics, or other related fields, the fluid is generally expelled by means of an actuating force acting in axial manner. This force is often exerted by the user pressing a thumb on the bottom of the device and while using other fingers of the same hand to hold the head of the device, which head incorporates the dispenser orifice. That type of dispenser device has a certain number of drawbacks, in particular in the case of nasal applications, since it often creates axial displacement of the whole of the device at the moment of actuation, in particular as a result of the resistance provided by the device during actuation. The user must force the bottom of the device somewhat in order to achieve said actuation, and, at the moment when said actuation takes place, a fraction of the force is released in such a manner that the arm or the hand of the user may be driven in the same axial direction, which can lead to a risk of injury, in particular when the dispenser orifice is inserted in a nostril.

To remedy that problem, it has been proposed to use laterally-actuated devices in which the user no longer exerts an axial force on the device, but instead exerts a lateral force transversely to the fluid-dispensing axis, e.g. by means of a button or a pivoting lateral lever, said transverse force being transformed into an axial force. In that known type of laterally-actuated dispenser device, the user holds the device in one hand by gripping the body of the device, or more generally the portion which incorporates the dispenser orifice, a digit, e.g. the thumb, being used to press the laterally-actuated element. Depending on the dispenser device used, in particular depending on the type of pump, or more generally on the type of dispenser means required for expelling the fluid, actuation requires a fairly substantial axial force. Unfortunately, in known laterally-actuated dispenser devices, the radial force exerted by the user is not transformed completely into an axial force enabling actuation, such that the user must press harder on a laterally-actuated device than would be required if exerting pressure axially. The user must thus exert a substantial force, which is not always possible, in particular with children or the elderly, or else actuator means must be provided that are sufficiently large in size to enable transformation to take place easily. However, such as increase in the size of the device often presents a drawback, whether in terms of cost of manufacture or of storage, or even from an ergonomic point of view.

CERTAIN OBJECTS OF THE INVENTION

An object of the present invention is to provide a laterally-actuated fluid dispenser device which does not have the above-mentioned drawbacks.

More particularly, an object of the present invention is to provide a laterally-actuated fluid dispenser device which, in all cases, enables lateral actuation to be achieved by means of the smallest possible radial force.

Another object of the present invention is to provide such a laterally-actuated fluid dispenser device which is simple and cheap to manufacture, assemble, and use.

Another object of the present invention is to provide such a laterally-actuated fluid dispenser device which is compact, ergonomic, and reliable.

The present invention therefore provides a fluid dispenser device comprising a body, a fluid reservoir containing one or a plurality of doses of fluid, a piston designed to slide in said reservoir so as to dispense a dose of fluid each time the device is actuated, and actuator means for displacing said piston, said device being characterized in that it includes at least two laterally-actuated elements distributed around said body, said laterally-actuated elements being displaced simultaneously in a direction that is approximately transverse to the central axis of the device, and each co-operating with a peripheral edge of said actuator means so as to exert an axial force thereon.

The present invention also provides a fluid dispenser device comprising a body, a fluid reservoir containing one or a plurality of doses of fluid, an air-flow generating system, such as a puffer or a bellows, connected to said reservoir, and actuator means for actuating said air-flow generating system, said device being characterized in that it includes at least two laterally-actuated elements distributed around said body, said laterally-actuated elements being displaced simultaneously in a direction that is approximately transverse to the central axis of the device, and each co-operating with a peripheral edge of said actuator means so as to exert an axial force thereon.

Each laterally-actuated element is advantageously made in the form of a lever pivotally mounted on said body.

Each lever advantageously includes a radial flange firstly connected to the body of the device, and secondly supporting an actuator blade extending approximately axially towards the bottom of the device, said actuator blade being deformed elastically between a rest position and an actuated position when the user exerts a radial force thereon, and returning resiliently to its rest position when the user withdraws the force.

Preferably, said actuator elements each have a cam surface co-operating with the peripheral edge of the actuator means.

Said cam surface is advantageously a sloping plane having a slope that varies during displacement of the actuator elements, said slope being at a maximum at the start of actuation and at a minimum at the end of actuation so that the radial actuation force exerted by the user on said actuator elements is transformed into an axial force for displacing the actuator means that is at a maximum at the end of actuation.

In a first variant embodiment, the reservoir contains a single dose of fluid that is expelled in a single actuation of the device.

In a second variant embodiment, the reservoir contains at least two doses, dose-measuring means being provided to divide the contents of the reservoir into a plurality of doses.

In an embodiment of the invention, said actuator means are connected to said piston.

In another embodiment, said actuator means are formed by, or connected to, said reservoir.

The dose-measuring means are advantageously designed to limit the stroke of the piston in the reservoir, each partial stroke corresponding to one dose of fluid.

Said dose-measuring means are advantageously provided on the laterally-actuated elements.

Said dose-measuring means are advantageously formed by a notch in the plane cam surface of at least one laterally-actuated element, said notch co-operating with the body to define the end of the actuating stroke of said actuator elements.

At least one laterally-actuated element advantageously has a notch in its plane cam surface, the notch co-operating with the body to define the end of the actuating stroke of the actuator elements.

Said peripheral edge of the actuator means is advantageously the bottom peripheral edge.

Said device preferably includes two laterally-actuated elements that are diametrically opposite each other about said body.

BRIEF DESCRIPTION OF DRAWINGS

Other characteristics and advantages of the present invention appear more clearly from the following detailed description of a particular embodiment thereof, made with reference to the accompanying drawing, and given by way of non-limiting example, in which.

DETAILED DESCRIPTION OF EMBODIMENTS OF THE INVENTION

The embodiment shown in the figures is a "single-dose" fluid dispenser device, i.e. it contains a single dose only of fluid in its reservoir. The following detailed description is therefore made with reference to this particular embodiment of the invention, but it is clear that the present invention is not limited to this type of device, but on the contrary applies equally to devices of the two-dose type, i.e. containing two doses, or even to devices containing more doses.

Figure 1:
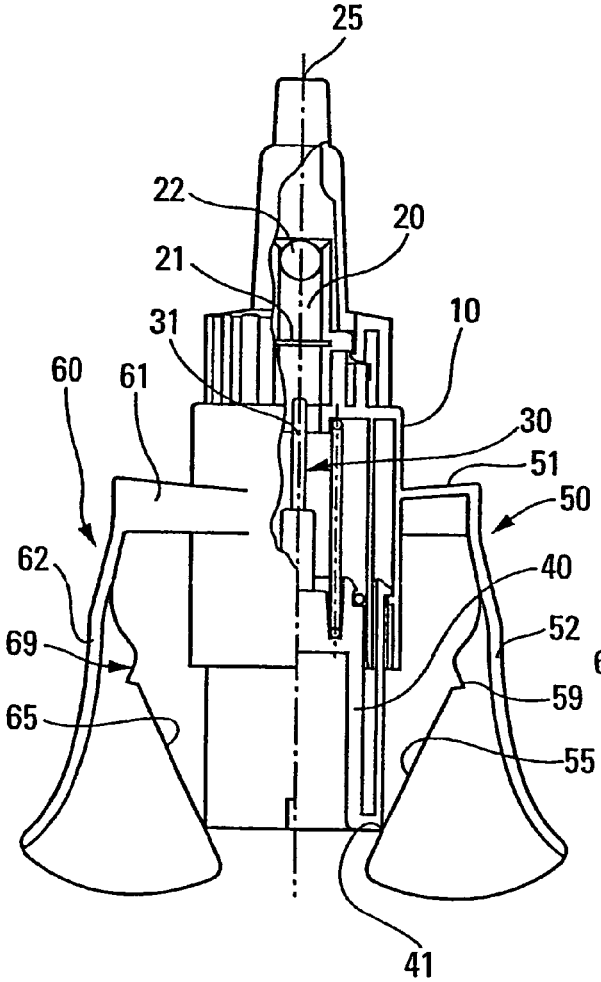
FIG. 1 is a partially exploded diagrammatic cross-section view of a fluid dispenser device of the present invention, in the rest position.

With reference to FIG. 1, the dispenser device comprises a body 10 in which there is disposed a fluid reservoir 20 connected firstly to dispenser means 30, and secondly to a dispenser orifice 25.

Figure 2:
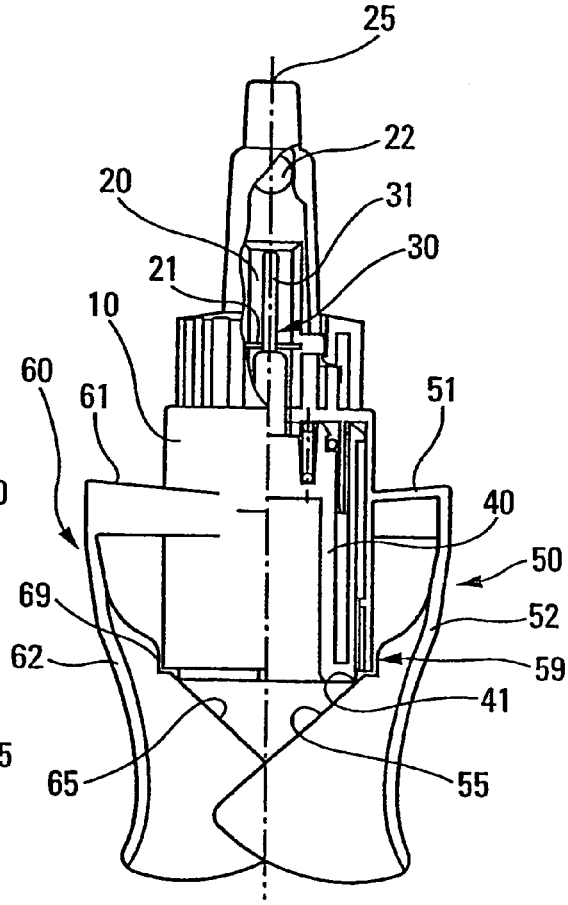
FIG. 2 is a view similar to that of FIG. 1, in the actuated position of the device.

The dispenser means 30 shown in FIGS. 1 and 2 are provided in the form of a puffer which is designed to generate a flow of compressed air, which, when the pin 31 connected to the puffer 30 comes to pierce the membrane of the reservoir 20, expels the closure bead 22, driving therewith the fluid contained inside the reservoir 20, towards the dispenser orifice 25. In this case, the fluid is generally a powder. To actuate the device, it is therefore necessary to compress the piston 40 of the puffer 30, the axial displacement of said piston 40 compressing the air inside the puffer chamber until the pin 31 comes to pierce the membrane 21 of the reservoir 20, thus releasing the flow of air firstly towards the closure bead 22, and then towards the dispenser orifice 25. Such axial compression of the piston 40, which forms the means for actuating the puffer 30, requires a force that increases with increasing compression of the air, as a result of the resistance of the air, until the compressed air is released during actuation.

In accordance with the invention, the device includes at least two laterally-actuated elements distributed around said body 10. There are preferably two actuator elements 50, 60 that are diametrically opposite each other about the body 10. The laterally-actuated elements 50, 60 are preferably formed on said body 10, in particular formed integrally as a single piece. The laterally-actuated elements 50, 60 are adapted to co-operate with an edge 41 of said piston 40, preferably by means of respective cam surfaces 55, 65 which are preferably formed by sloping planes. Advantageously, said edge 41 is the outside bottom peripheral edge.

As shown in the drawings, each laterally-actuated element 50, 60 is made in similar manner, and advantageously includes a radial flange 51 which, firstly, is connected to the body 10, and which, secondly, is extended by a blade extending downwards in the drawings, and which includes said respective cam surface 55, 65. As shown in the drawings, the cam surface 55, 65 of each laterally-actuated element 50, 60 advantageously co-operates with the peripheral edge 41, which, in this case, is the outside bottom edge, and, as a result of the cam surface being made in the form of a sloping plane, the point of contact between the respective laterally-actuated element 50, 60 and the actuator means formed by the piston 40 remains said outside edge 41 throughout the entire actuating stroke.

As a result of providing at least two actuator elements that are identical and that are actuated simultaneously, it is possible to reduce the transformation of transverse force into axial force on the piston, so that the user only has to exert a relatively small force on the laterally-actuated elements in order to actuate the device, even if the device presents significant resistance.

A particularly advantageous aspect of the present invention is that, in fluid dispenser devices, in particular those containing one or two doses, the actuating force increases during the actuating stroke, so as to reach a maximum just before dispensing. The present invention satisfies this characteristic by the fact that the slope of the cam surface 55, 65 of each laterally-actuated element 50, 60, which is formed by a sloping plane, varies during actuation. Thus, in the position shown in FIG. 1, the slope is fairly steep, which implies relatively little transformation of force, whereas in the position shown in FIG. 2 the slope is much shallower, so that the transformation of the radial force exerted by the user is then much greater. Thus, the transformation of force reaches a maximum at the end of the actuating stroke, when the resistance of the dispensing device is also at a maximum, so that the present invention actually enables the device to be actuated by means of a relatively constant force exerted on the two laterally-actuated elements 50, 60. The modification of the slope during actuation implies an increasing transformation of the actuating force of the user, which compensates for the increase in the resistance of the puffer in the example shown in the figures.

Figure 3:
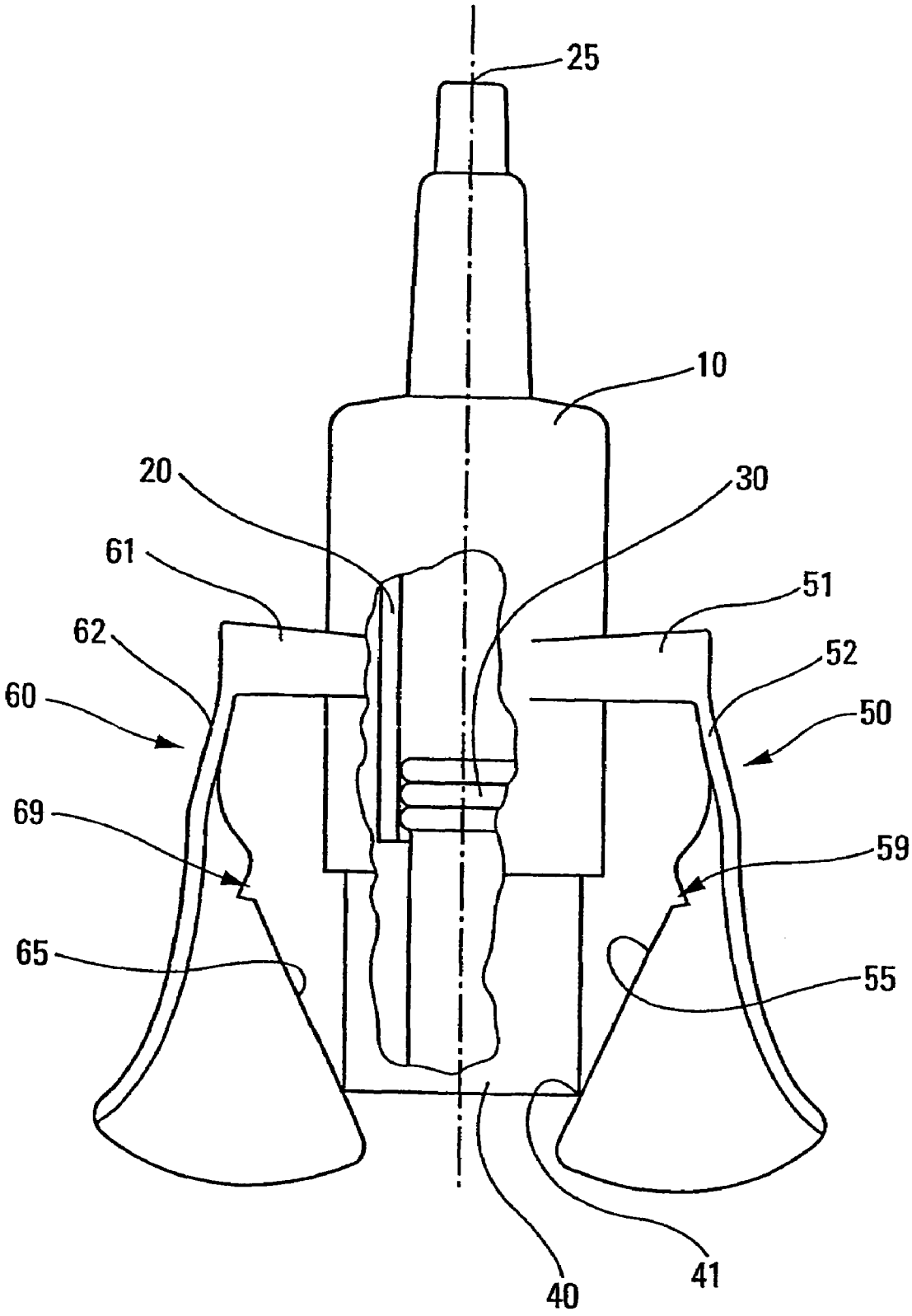
FIG. 3 is a diagrammatic view of another embodiment of the present invention.
Figure 4:
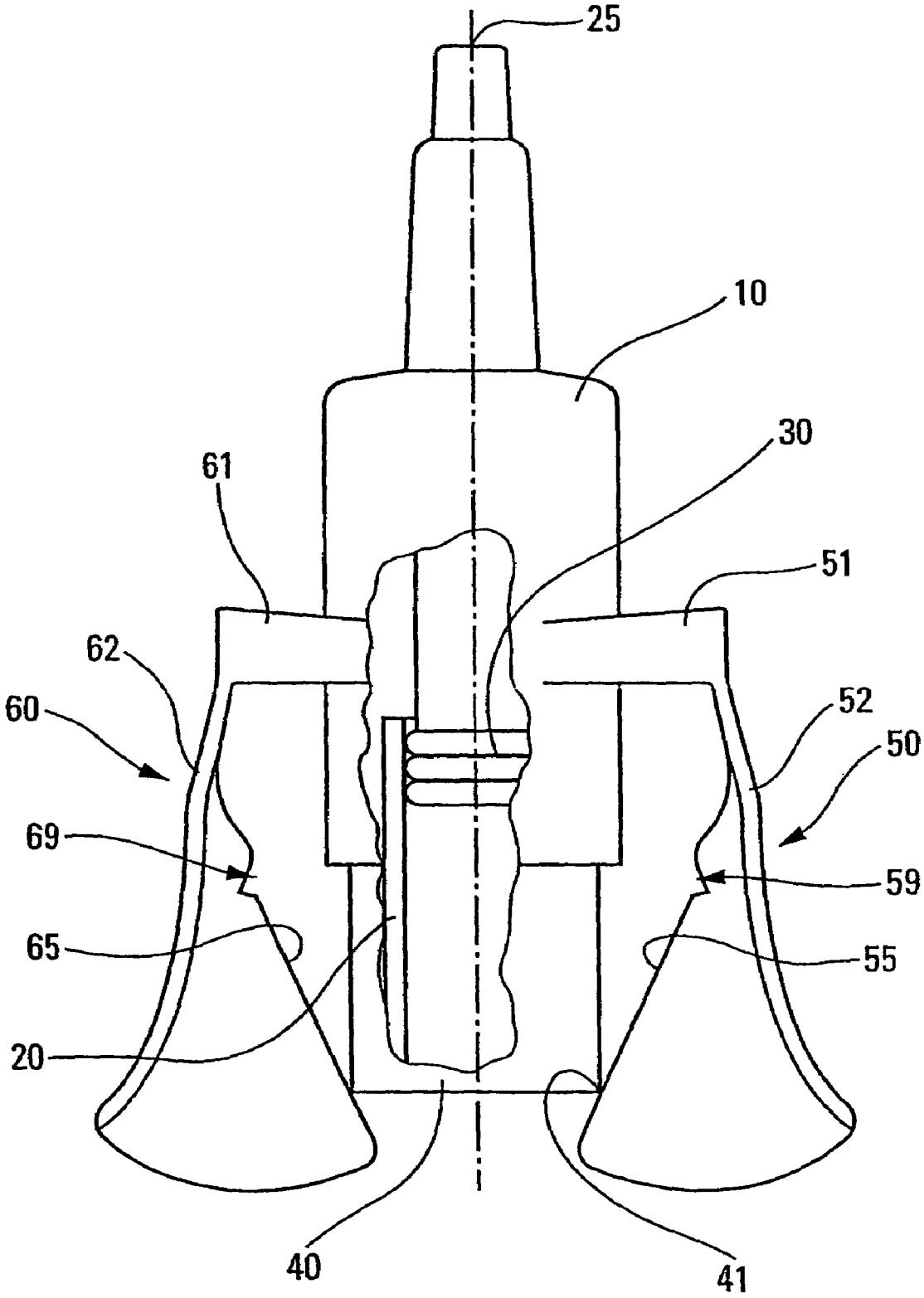
FIG. 4 is a diagrammatic view of yet another embodiment of the present invention.

In the embodiments shown in FIGS. 3 and 4, the dispenser means 30 are provided in the form of a piston 30 that is displaced in sealed manner in the reservoir 20. The actuator means 40 can thus either be connected to said piston 30, as shown in FIG. 3, or can be connected to said reservoir 20, as shown in FIG. 4, so as to induce a relative axial displacement between said two elements. In which case, the situation is identical, namely that the resistance is at a maximum at the end of the actuating stroke, and the present invention continues to makes it possible to remedy this difficulty as described above. The reservoir 20 can contain a single dose of fluid, in which case the dose is dispensed in a single actuation. In a variant, the reservoir can contain two or more doses of fluid, in which case dose-measuring means are advantageously provided so as to limit the stroke of the piston in the reservoir. In this case, the actuator means can include resilient return means for returning to the rest position after each actuation.

Abutment means 59, 69 are advantageously provided so as to define the end of the actuating stroke of the actuator elements. The abutment means can be provided in the form of notches 59, 69 formed in the cam surface 55, 65 of at least one of the laterally-actuated elements 50, 60, and preferably in each of them. As shown in FIG. 2, the notches 59, 69 co-operate at the end of the actuating stroke with the bottom edge of the body 10. In the above-mentioned example, in which a piston slides in a reservoir containing two or more doses, the notches 59, 69 also enable dose-measuring means to be defined, by defining the end of the actuating stroke of the piston in the reservoir, the following dose being dispensed during the following actuation.

In addition to reducing the actuating force on the fluid dispenser device, and therefore facilitating actuation of said device, the use of two or more laterally-actuated elements of the present invention is more ergonomic, and in particular provides symmetry during actuation, i.e. the user exerts approximately the same radial force on each of the laterally-actuated elements 50, 60. This results in a dispenser device which, as a whole, is very stable both in the axial direction, since the user no longer exerts axial force on the device, and in radial position, since the user exerts the same force on each side of the device. This is not the case with the known laterally-actuated device, in which the device is held in the hand, and the force is exerted only by means of a finger on one side of the device. Depending on the magnitude of the force that is exerted, this could lead to radial force imbalance, and therefore to a displacement of the entire device in the direction of said radial force. The present invention therefore overcomes that drawback, which can be advantageous when the dispenser orifice 25 is inserted in a nostril, in which case dispensing accuracy and low risk of injury are enhanced by the present invention.

Although the present invention is described with reference to a particular embodiment, it is clear that it is not limited to said embodiment. As mentioned above, the device is not necessarily a single-dose device, but could be a two-dose device, or even a device containing more than two doses, as long as dose-measuring means are provided in the device. As explained above, the dose-measuring means can advantageously form part of the laterally-actuated elements. In addition, the dispenser means are not limited to the puffer shown in the drawings, but other dispenser means, in particular a piston sliding in the reservoir, can be envisaged. In addition, the device can include more than two laterally-actuated elements, e.g. three or four, distributed at regular intervals around the body of the device. In addition, the peripheral edge with which each laterally-actuated element co-operates is not necessarily the bottom edge, and it is also not necessarily formed by a sharp edge, but could alternatively be a sloping edge corresponding to the cam surface of the actuator elements. Other modifications can also be made by the person skilled in the art without going beyond the ambit of the present invention, as defined by the accompanying claims.

The invention claimed is:

1. A fluid dispenser device comprising a body (10), a fluid reservoir (20) containing one or a plurality of doses of fluid, a piston (30) designed to slide in a sealed manner in said reservoir so as to dispense a dose of fluid each time the device is actuated, and actuator means (40) for displacing said piston (30), said device includes at least two laterally-actuated elements (50, 60) distributed around said body (10), said laterally-actuated elements (50, 60) being displaced simultaneously in a direction that is approximately transverse to a central axis of the device, and each laterally-actuated element co-operating with a peripheral edge (41) of said actuator means (40) so as to exert an axial force thereon.

2. A device according to claim 1, in which said each laterally-actuated element (50, 60) is made in a form of a lever pivotally mounted on said body (10).

3. A device according to claim 2, in which each lever (50, 60) includes a radial flange (51, 61) firstly connected to the body (10) of the device, and secondly supporting an actuator blade (52, 62) extending approximately axially towards a bottom of the device, said actuator blade (52, 62) being deformed elastically between a rest position and an actuated position when a user exerts a radial force thereon, and returning resiliently to its rest position when the user withdraws the force.

4. A device according to claim 1, in which said laterally-actuated elements (50, 60) each have a cam surface (55, 65) co-operating with the peripheral edge (41) of the actuator means (40).

5. A device according to claim 4, in which said cam surface (55, 65) is a sloping plane having a slope that varies during displacement of the laterally-actuated elements, said slope being at a maximum at a start of actuation and at a minimum at an end of actuation so that a radial actuation force exerted by a user on said laterally-actuated elements (50, 60) is transformed into the axial force for displacing the actuator means (40) that is at the maximum at the end of actuation.

6. A device according to claim 1, in which the reservoir (10) contains a single dose of fluid that is expelled in a single actuation of the device.

7. A device according to claim 1, in which the reservoir (10) contains at least two doses, dose-measuring means being provided to divide contents of the reservoir into the plurality of doses.

8. A device according to claim 6, in which said actuator means (40) are connected to said piston.

9. A device according to claim 6, in which said actuator means (40) are formed by, or connected to, said reservoir (10).

10. A device according to claim 7, in which the dose-measuring means are designed to limit a stroke of the piston (30) in the reservoir (20), each partial stroke corresponding to one dose of fluid.

11. A device according to claim 10, in which said dose-measuring means are provided on the laterally-actuated elements (50, 60).

12. A device according to claim 4, in which said dose-measuring means are formed by a notch (59, 69) in the plane cam surface (55, 65) of at least one laterally-actuated element (50, 60), said notch (59, 69) co-operating with the body (10) to define an end of an actuating stroke of said laterally-actuated elements (50, 60).

13. A device according to claim 4, in which at least one laterally-actuated element (50, 60) has a notch (59, 69) in its plane cam surface (55, 65), the notch co-operating with the body (10) to define the end of the actuating stroke of the actuator elements (50, 60).

14. A device according to claim 1, in which said peripheral edge (41) of the actuator means (40) is a bottom peripheral edge.

15. A device according to claim 1, in which said device includes two laterally-actuated elements (50, 60) that are diametrically opposite each other about said body (10).

16. A fluid dispenser device comprising a body (10), a fluid reservoir (20) containing one or a plurality of doses of fluid, an air-flow generating system (30) connected to said reservoir, and actuator means (40) for actuating said air-flow generating system (30), said device includes at least two laterally-actuated elements (50, 60) distributed around said body (10), said laterally-actuated elements (50, 60) being displaced simultaneously in a direction that is approximately transverse to a central axis of the device, and each laterally-actuated element co-operating with a peripheral edge (41) of said actuator means (40) so as to exert an axial force thereon.

17. The device according to claim 16, wherein the air-flow generating system is a puffer or a bellows.

18. The device according to claim 16, wherein the fluid is a powder.

19. A fluid dispenser device comprising a body (10), a fluid reservoir (20) containing one or a plurality of doses of fluid, a piston (30) designed to slide in said reservoir so as to dispense a dose of fluid each time the device is actuated, and actuator means (40) for displacing said piston (30), said device includes at least two laterally-actuated elements (50, 60) distributed around said body (10), said laterally-actuated elements (50, 60) being displaced simultaneously in a direction that is approximately transverse to a central axis of the device, and each laterally-actuated element co-operating with a peripheral edge (41) of said actuator means (40) so as to exert an axial force thereon;

wherein said each laterally-actuated element (50, 60) is made in a form of a lever pivotally mounted on said body (10); and wherein each lever (50, 60) includes a radial flange (51, 61) firstly connected to the body (10) of the device, and secondly supporting an actuator blade (52, 62) extending approximately axially towards a bottom of the device, said actuator blade (52, 62) being deformed elastically between a rest position and an actuated position when a user exerts a radial force thereon, and returning resiliently to its rest position when the user withdraws the force.

20. A fluid dispenser device comprising:

a body;

a reservoir comprising a fluid;

a piston that slides to apply pressure to a dose of the fluid each time the device is actuated so as to expel the fluid from the device;

an actuator that displaces the piston; and at least two laterally-actuated elements distributed around the body, the laterally-actuated elements configured to be displaced simultaneously in a direction that is approximately transverse to a central axis of the device, each laterally-actuate element co-operating with an edge of the actuator so as to exert an axial force thereon.

* * * * *